US008167542B1

(12) United States Patent
Owusu

(10) Patent No.: US 8,167,542 B1
(45) Date of Patent: May 1, 2012

(54) CENTRIFUGAL FAN WITH 360 DEGREE CONTINUOUS ROTATION

(76) Inventor: Elijah A. Owusu, Worcester, MA (US)

( * ) Notice: Subject to any disclaimer, the term of this patent is extended or adjusted under 35 U.S.C. 154(b) by 1100 days.

(21) Appl. No.: 12/038,148

(22) Filed: Feb. 27, 2008

(51) Int. Cl.
*F01D 25/24* (2006.01)
*F03B 11/02* (2006.01)
*B64C 11/06* (2006.01)

(52) U.S. Cl. ..... 415/127; 416/100; 416/246; 417/423.1

(58) Field of Classification Search ..... 416/98, 416/100, 244 R, 246; 415/126, 127; 417/423.1, 417/423.14
See application file for complete search history.

(56) References Cited

U.S. PATENT DOCUMENTS

| | | | | |
|---|---|---|---|---|
| 1,005,429 | A | 10/1911 | Hollander | |
| 1,624,301 | A * | 4/1927 | Yokoyama | 368/88 |
| 1,814,243 | A * | 7/1931 | Chryst | 310/167 |
| 4,472,110 | A | 9/1984 | Sun Keu | |
| 5,013,224 | A | 5/1991 | Liao | |
| D335,703 | S * | 5/1993 | Liao | D23/380 |
| 5,266,004 | A * | 11/1993 | Tsumurai et al. | 416/100 |
| 5,851,106 | A | 12/1998 | Steiner et al. | |
| 6,537,029 | B1 | 3/2003 | Chen-Lung et al. | |
| D486,218 | S * | 2/2004 | Shapiro | D23/381 |
| 6,953,322 | B2 * | 10/2005 | Lim | 416/100 |
| D522,124 | S * | 5/2006 | Bucher et al. | D23/378 |
| 7,118,323 | B2 * | 10/2006 | Iyer et al. | 415/53.1 |
| 7,217,098 | B2 * | 5/2007 | Lim | 416/100 |

FOREIGN PATENT DOCUMENTS

| | | | |
|---|---|---|---|
| JP | 59150235 | A * | 8/1984 |
| JP | 2001295796 | A * | 10/2001 |
| JP | 2004044938 | A * | 2/2004 |

OTHER PUBLICATIONS

Translation of Yano et al. (JP 59150235 A).*
Translation and Abstract Translation of Amai (JP 2001295796 A).*
Translation and Abstract Translation of Iwai (JP 2004044938 A).*

* cited by examiner

*Primary Examiner* — Edward Look
*Assistant Examiner* — Su Htay

(57) ABSTRACT

This patent discloses a fan capable of 360 degree continuous rotation. The fan may include an impeller positioned within the impeller housing, an impeller motor fixed to the impeller housing, where a control knob may control the impeller motor. The fan further may include an impeller shaft connected between the impeller and the impeller motor to rotate the impeller and the impeller housing may reside on a base. A contact ring may be positioned within the base. The impeller motor and the impeller housing may rotate relative to the contact ring, which may provide power to the impeller motor through brushes. A housing motor may be positioned within the base and be connected to the impeller motor to rotate the impeller motor. A housing motor switch may control the housing motor.

4 Claims, 6 Drawing Sheets

CENTRIFUGAL FAN WITH 360 DEGREE CONTINUOUS ROTATION

BACKGROUND

1. Field

The information disclosed in this patent relates to a centrifugal fan capable of 360 degree continuous rotation.

2. Background Information

Mechanical fans produce airflow to create cooled down a household room that provides comfort to those in the room. Typically, the direction output of a mechanical fan is limited, which limits its cooling effect throughout a room. What is needed is a fan to overcome these and other problems.

SUMMARY

This patent discloses a fan capable of 360 degree continuous rotation. The fan may include an impeller positioned within the impeller housing, an impeller motor fixed to the impeller housing, where a control knob may control the impeller motor. The fan further may include an impeller shaft connected between the impeller and the impeller motor to rotate the impeller and the impeller housing may reside on a base. A contact ring may be positioned within the base. The impeller motor and the impeller housing may rotate relative to the contact ring, which may provide power to the impeller motor through brushes. A housing motor may be positioned within the base and be connected to the impeller motor to rotate the impeller motor. A housing motor switch may control the housing motor.

DETAILED DESCRIPTION

Figure 1:
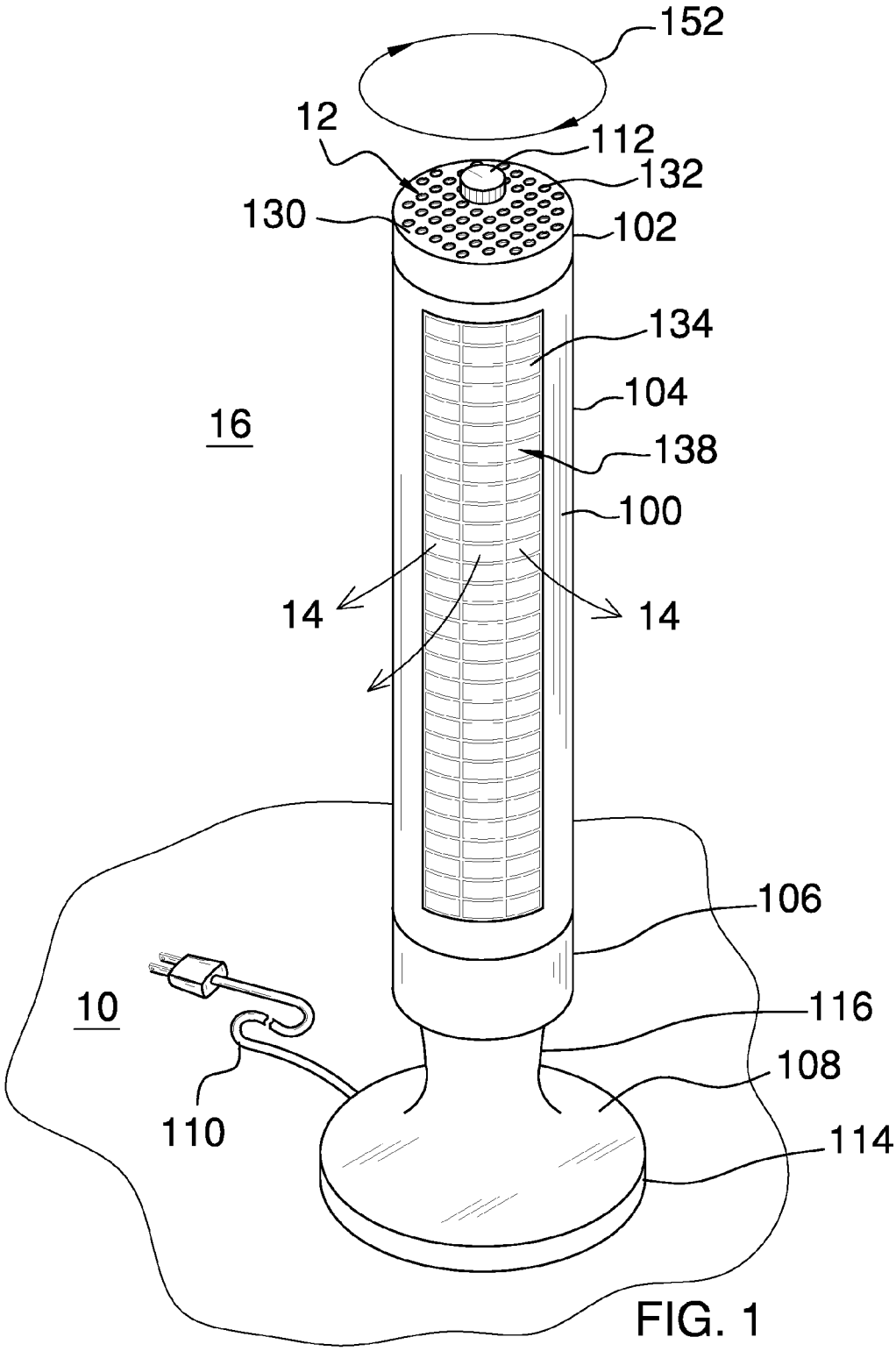
FIG. 1 is an isometric view of fan 100.
Figure 2:
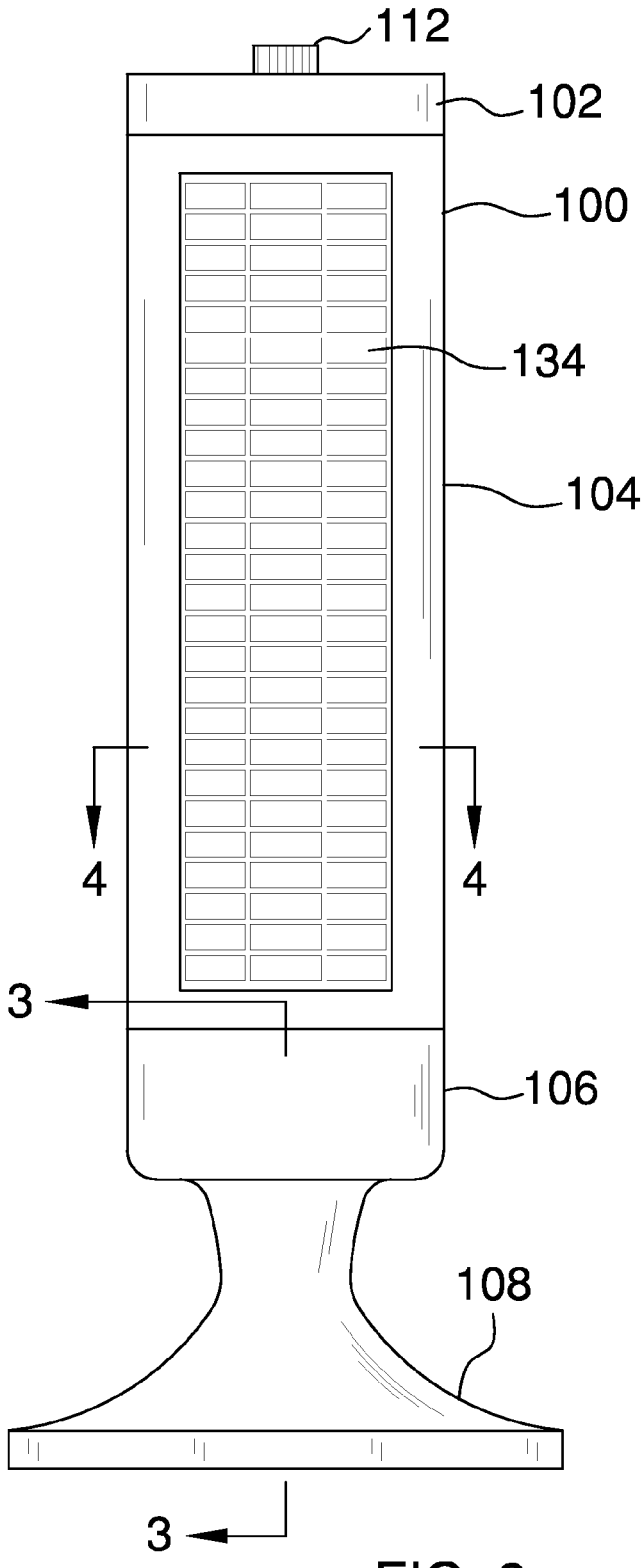
FIG. 2 is a side view of fan 100.

FIG. 1 is an isometric view of fan 100. FIG. 2 is a side view of fan 100. Fan 100 may be a centrifugal fan capable of 360 degree continuous rotation with directional output. In this regard, the output of fan 100 may be over an entire room. Thus, any person in the room may receive an evaporative cooling effect to the skin no matter where they are in the room. As a centrifugal fan, fan 100 may have a small footprint.

Fan 100 may include a fan cap 102, an impeller housing 104, a motor housing 106, a base 108, and a power cord 110. Impeller housing 104 may be secured between fan cap 102 and motor housing 106. A control knob 112 may be attached to a fan cap top 130 of fan cap 102. Base 108 may include a platform 114 and a trunk 116. Motor housing 106 may reside on trunk 116, power cord 110 may pass into platform 114, and platform 114 may reside on a ground 10. Room air 12 may enter fan 100 and leave as conditioned air 14.

Figure 3:
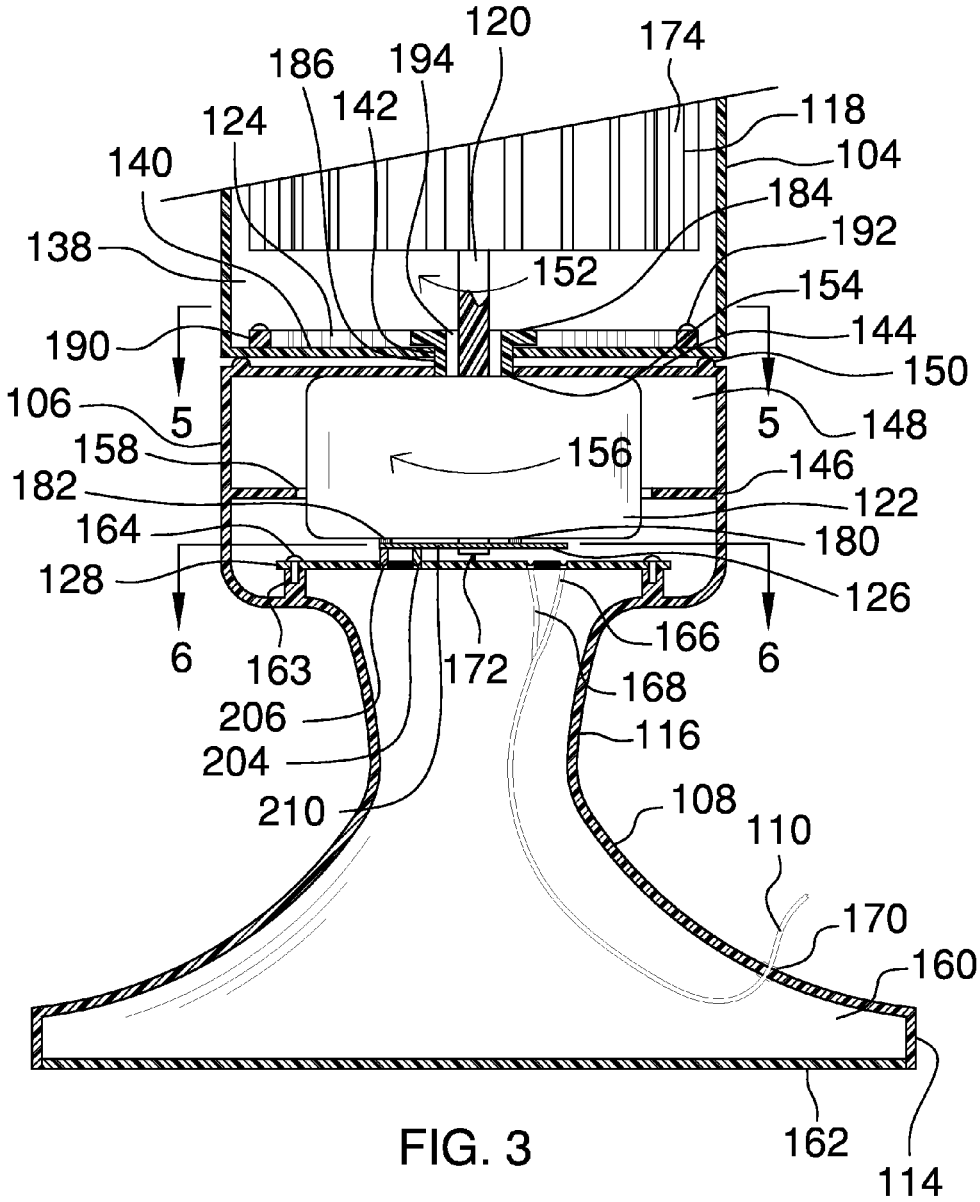
FIG. 3 is a partial section view of fan 100 generally taken off line 3-3 of FIG. 2.

FIG. 3 is a partial section view of fan 100 generally taken off line 3-3 of FIG. 2. Fan 100 additionally may include an impeller 118, an impeller shaft 120, a motor 122, a gear system 124, a contact ring 126, and a contact ring support 128. Impeller 118 may reside within impeller housing 104. Impeller shaft 120 may connect impeller 118 to motor 122 such that rotation of impeller 118 may be controlled by motor 122. Impeller shaft 120 additionally may connect motor 122 to contact ring 126 where both motor 122 and impeller shaft 120 may rotate relative to contact ring 126. Gear system 124 may connect motor 122 to impeller housing 104 such that impeller housing 104 may rotate as motor 122 rotates. Contact ring support 128 may connect contact ring 126 to motor housing 106.

Fan cap 102 may be a round cover positioned at an upper side of impeller housing 104. Fan cap 102 may have fan cap top 130 as an uppermost surface and include fan cap holes 132 in fan cap top 130. Fan cap holes 132 may be pattern openings through fan cap top 130 to admit room air 12 into impeller housing 104. In one example, each fan cap hole 132 may have an oval shape.

Impeller housing 104 may be a protective cover to contain and support mechanical components, such as impeller 118. Impeller housing 104 may be elongated and have a hollow tube shape. A first louver openings 134 may be positioned through impeller housing 104 and a second louver openings 136 (FIG. 4) may be positioned through impeller housing 104 on a side of impeller housing 104 that is opposite of first louver openings 134. Both first louver openings 134 and second louver openings 136 may lead to an impeller housing interior 138. In addition, both first louver openings 134 and second louver openings 136 may include a pattern of empty spaces with horizontal slats to permit passage of conditioned air 14 from impeller housing interior 138 into a room 16 (FIG. 1).

Figure 5:
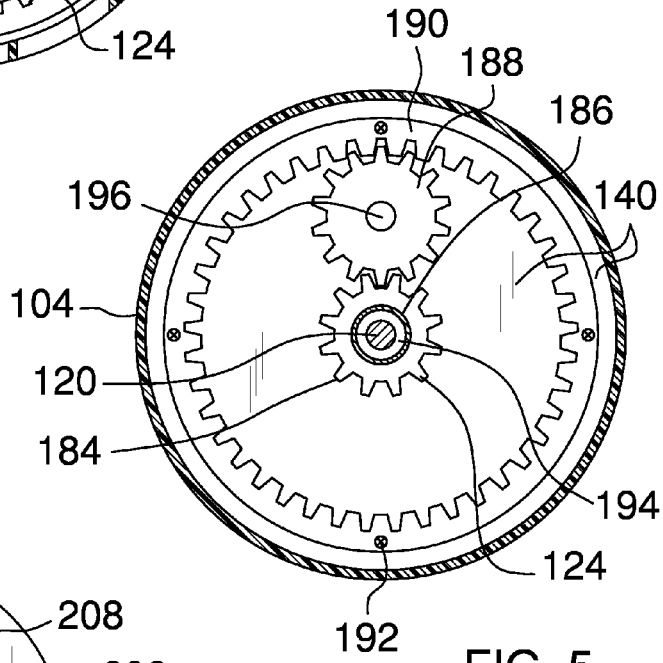
FIG. 5 is a section view of fan 100 generally taken off line 5-5 of FIG. 3.

Impeller housing 104 may include an impeller housing bottom 140 (FIG. 3 and FIG. 5). Impeller housing bottom 140 may be a flat, disc shaped support structure at a lowest portion of impeller housing 104. Impeller housing bottom 140 may include an impeller housing bottom opening 142 in a center of impeller housing bottom 140 to permit both impeller shaft 120 and gear system 124 to pass there through.

Motor housing 106 may be a protective cover to contain and support mechanical components, such as motor 122. Motor housing 106 generally may have a hollow tube shape and may include a motor housing bearing plate 144 and a motor stabilizer ring 146. Motor housing bearing plate 144 may be attached to the top of motor housing 106 to be positioned between impeller housing 104 and motor 122. Motor stabilizer ring 146 may be attached to motor housing 106 within a motor housing interior 148 and below motor housing bearing plate 144.

Motor housing bearing plate 144 may be a rigid disc set on top of motor housing 106 to support impeller housing bottom 140. Motor housing bearing plate 144 may include a thrust bearing 150 positioned on top of motor housing bearing plate 144 and against impeller housing bottom 140. Thrust bearing 150 may be a rotational support ring designed to take thrusts from impeller housing 104 that are parallel to the axis of revolution of thrust bearing 150 and to prevent impeller housing 104 to rotate in a direction of rotation arrow 152 (FIG. 1) with little to no wobble. Motor housing bearing plate 144 may include a motor housing bearing plate opening 154 in a center of motor housing bearing plate 144 to permit both impeller shaft 120 and gear system 124 to pass there through.

Motor stabilizer ring 146 may be a rigid support extending radially inward from motor housing 106 towards motor 122.

Motor 122 may rotate in a direction of rotation arrow 156 and motor stabilizer ring 146 may restrain motor 122 from wobbling. Motor stabilizer ring 146 may include a rolling-element bearing 158 and motor 122 may be positioned within rolling-element bearing 158. Rolling-element bearing 158 may be a bearing that may carry a load by placing round elements between motor 122 and motor stabilizer ring 146. Relative motion between rotating motor 122 and motor stabilizer ring 146 may cause the round elements in rolling-element bearing 158 to roll (tumble) with little sliding.

Base 108 may be a foundation upon which impeller housing 104, impeller 118, and motor 122 may be supported. Base 108 may include a base interior 160, where base interior 160 may be hollow. Platform 114 may be a raised round support having a removable flat bottom 162. Trunk 116 may rise up from platform 114 to meet motor housing 106. In one example, part of platform 114, trunk 116, and motor housing 106 may be a single piece product that may result from a single injection molding process. Base 108 may include contact ring bosses 163. Contact ring bosses 163 may be round projections extending into motor housing interior 148 and having internal threads configured to receive screws 164.

Power cord 110 may be a cord set or cable that may temporarily connect fan 100 to an electrical power source. Power cord 110 may include a cable having a power plug to connect to a single-phase alternating current power source at mains voltage (100 to 240 volts). The power from power cord 110 may include a positive terminal 166 and a negative terminal 168. Power cord 110 may pass into base interior 160 through a grommet 170 where positive terminal 166 and negative terminal 168 may connect to contact ring support 128 from underneath contact ring support 128.

Control knob 112 (FIG. 1) may be a handle positioned in a center of fan cap 102 and have a round shape that may be rotated by a person's fingers. Rotating control knob 112 may operate fan 100 such as by turning on and off fan 100. Control knob 112 may be wirelessly connected to motor 122. Control knob 112 may be connected to motor 122 through wires 172. For example, wires 172 may pass from control knob 112 through a vertical center of impeller shaft 120 and connect to contact ring support 128 to engage power from power cord 110.

Figure 4:
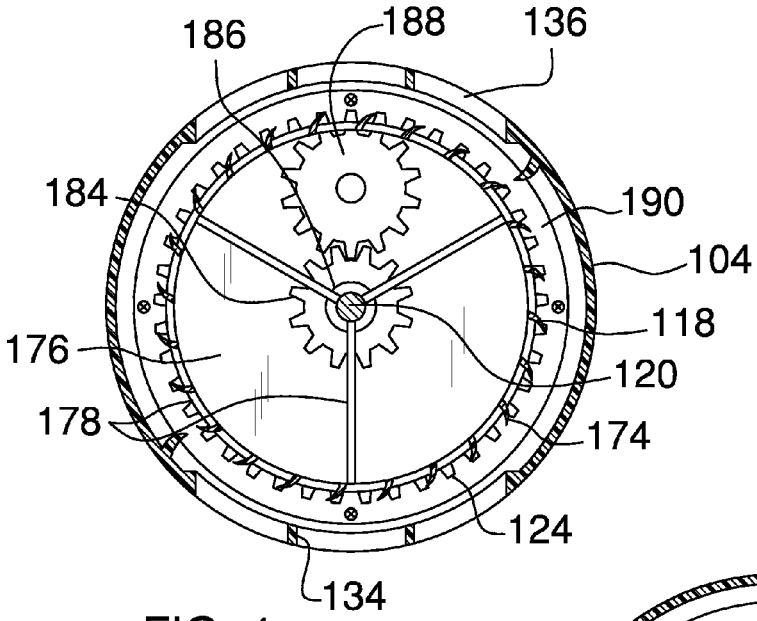
FIG. 4 is a section view of fan 100 generally taken off line 4-4 of FIG. 2.

FIG. 4 is a section view of fan 100 generally taken off line 4-4 of FIG. 2. Impeller 118 may be a device to create a current of air (conditioned air 14) by movement of blades 174. Impeller 118 may include an impeller interior 176 and impeller support structure 178. Impeller support structure 178 may be a wheel-shaped structure that surrounds impeller interior 176 and extends to attach to impeller shaft 120 so that impeller 118 may rotate with impeller shaft 120. Blades 174 may be vanes spaced apart from one another along a perimeter of impeller 118. Blades 174 may be curved both to draw room air 12 through both fan cap holes 132 and impeller interior 176 and to expel conditioned air 14 through louver openings 134 and louver openings 136.

Impeller shaft 120 may be a vertically orientated, round rod to transfer rotary motion from motor 122 to impeller 118. Impeller shaft 120 may pass through gear system 124 and motor 122 to rotatably connected at one end to a center of contact ring 126 (FIG. 3). Impeller shaft 120 may be rotatably connected at another end to cap 102 and may be spun by motor 122 in a direction of rotation arrow 156 (FIG. 3).

Motor 122 may be a device that converts electrical power into rotary mechanical motion. Motor stabilizer 146 may be fixed and motor 122 itself may rotate relative to motor stabilizer 146 to turn impeller housing 104 in a direction of rotation arrow 156 (FIG. 3) through gear system 124. Motor 122 may cause a continuous 360 degree rotation of impeller housing 104 so that louver openings 134 and louver openings 136 both continuously rotate. Motor 122 also may rotate impeller 118 through impeller shaft 120 in a direction of rotation arrow 152 (FIG. 1). Impeller 118 may rotate faster than impeller housing 104 to create conditioned air 14. Here, conditioned air 14 may exit through the slower rotating louver openings 134 and louver openings 136 to be disbursed throughout room 16.

Motor 122 may rotate relative to contact ring 126 and receive power from contact ring 126. To receive power from contact ring 126 and rotate relative to contact ring 126, motor 122 may include a negative brush 180 and a positive brush 182. Negative brush 180 and positive brush 182 each may include metallic bristles that extend down from motor 122 to run against contact ring 126 as motor 122 rotates relative to contact ring 126. The metallic bristles may convey electricity from contact ring 126 into motor 122 to power motor 122. Negative brush 180 may be positioned closer to impeller shaft 120 than positive brush 182.

FIG. 5 is a section view of fan 100 generally taken off line 5-5 of FIG. 3. Gear system 124 may be an arrangement of toothed wheels to transmit rotary motion from motor 122 to impeller housing 104. Gear system 124 may include a drive gear 184 having a drive gear shaft 186 and include an idler gear 188, a rotation gear 190, and rotation gear fasteners 192. Drive gear shaft 186 may pass through impeller housing bottom opening 142 and motor housing bearing plate opening 154 to connect motor 122 to drive gear 184. Idler gear 188 may connect drive gear 184 to rotation gear 190. Rotation gear fasteners 192 may secure rotation gear 190 to impeller housing bottom 140.

Drive gear 184 may rotate impeller housing 104 and impeller shaft 120 may rotate impeller 118. As note above, impeller 118 may rotate faster than impeller housing 104 to create conditioned air 14. A reason for this is that, although drive gear 184 and impeller shaft 120 may rotate at the same speed, rotation gear 190 may have more teeth than drive gear 184 and thus turn more slowly than both drive gear 184 and impeller shaft 120.

In one example, drive gear 184 may have twelve teeth and rotation gear 190 may have forty-one teeth. The gear ratio is therefore 12/41 or 1/3.42 (also written as 1:3.42). This means that for every one revolution of drive gear 184 (impeller 118), rotation gear 190 (impeller housing 104) has made 1/3.42, or about 0.3 revolutions. In practical terms, impeller housing 104 turns more slowly than impeller 118, through a total reduction of around 1:3.

Drive gear 184 may be an externally toothed wheel that may engage idler gear 188 to change the speed and/or direction of transmitted motion to idler gear 188. Drive gear 184 may rest on or adjacent to impeller housing bottom 140. Drive gear shaft 186 may extend downward from drive gear 184. A drive gear opening 194 may pass through drive gear 184 and drive gear shaft 186 to permit impeller shaft 120 to pass through drive gear opening 194. In one example, impeller shaft 120 and drive gear shaft 186 may be one in the same.

Idler gear 188 may be an externally toothed wheel that may engage rotation gear 190 to change the speed and/or direction of transmitted motion to idler gear 188. Idler gear 188 may be rotatably attached to impeller housing bottom 140 by an idler gear fastener 196 (FIG. 5). In one example, impeller housing bottom 140 may be metal and idler gear fastener 196 may be a magnet.

Rotation gear 190 may be an internally toothed wheel that may receive transmitted motion from idler gear 188 to move impeller housing 104. The teeth of rotation gear 190 may be distributed over 360 degrees. Here, idler gear 188 may exert a push force on rotation gear 190. Rotation gear fasteners 192 may be four screws that pass through rotation gear 190 and into impeller housing bottom 140 to secure rotation gear 190 to impeller housing bottom 140. As best seen in FIG. 3, thrust bearing 150 may have an interior diameter that may be greater than an exterior diameter of rotation gear 190. Since thrust bearing 150 may have an interior diameter that may be greater than an exterior diameter of rotation gear 190, thrust bearing 150 may reside outside of the push force between idler gear 188 and rotation gear 190 and be in a position to counter any downward cantilever force on impeller housing 104 from that push force.

Figure 6:
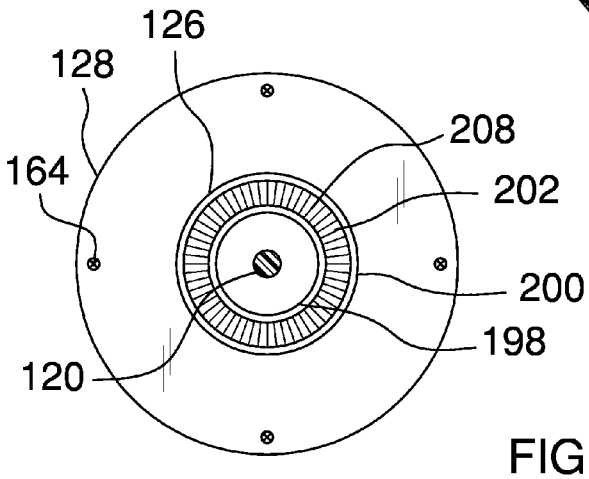
FIG. 6 is a section view of fan 100 generally taken off line 6-6 of FIG. 3.

FIG. 6 is a section view of fan 100 generally taken off line 6-6 of FIG. 3. Contact ring 126 may be a disc structure that may support impeller shaft 120 and motor 122 and provide electricity to motor 122 from contact ring support 128. Contact ring 126 may include a negative voltage track 198, a positive voltage track 200, insulation 202, a negative pathway stand 204 (FIG. 3), and a positive pathway stand 206. Insulation 202 may separate negative voltage track 198 from positive voltage track 200 on a contact ring upper surface 208. Negative pathway stand 204 and positive pathway stand 206 may extend from a contact ring lower surface 210 (FIG. 3) and be secured to contact ring support 128. Negative pathway stand 204 may be electrically connected to negative voltage track 198 and positive pathway stand 206 may be electrically connected to positive voltage track 200.

Negative voltage track 198 and positive voltage track 200 each may be concentric rings made of a metal conductor. Negative brush 180 of motor 122 may move along negative voltage track 198 to receive a negative current from negative voltage track 198 and positive brush 182 of motor 122 may move along positive voltage track 200 to receive a positive current from positive voltage track 200. Insulator 202 may be a ring made of a material that is a poor conductor of electricity. This may prevent negative voltage track 198 from shorting with positive voltage track 200.

Negative pathway stand 204 and positive pathway stand 206 each may include metal conductors and a structural support element. The metal conductors may pass electricity from contact ring support 128 to negative voltage track 198 and positive voltage track 200, respectively. The structural support elements may be rigid enough to support the weight of motor 122 and elements connected to motor 122. Both negative pathway stand 204 and positive pathway stand 206 may be offset from a center of contact ring 126 to provide a spring like support to motor 122.

Contact ring support 128 may be a resiliently rigid plate attached to contact ring bosses 163 by screws 164. Contact ring support 128 may support contact ring 126 above base interior 160. Contact ring support 128 may be resilient and provide some give that may adjust to slight up and down movements of motor 122.

The fan may include a lower base assembly from which a power cord may extend. The upper portion of the base may be equipped with a contact ring and brush assembly that may be linked to an upper electric motor. Brushes moving over the contact ring may conduct electricity into the motor. The contact ring and its negative and positive discs need not rotate. The motor may be used to power a centrifugal blower that may draw air in from above. The motor and blower may be enclosed in a cylindrical housing, a portion of which may be equipped with a louvered outlet vent.

In operation, the motor may rotate to rotate the housing continuously, thereby distributing the output of the unit over an entire room. The rotation may be made possible by electromagnetism. The base of the fan may be attached with a magnet aligned on the edges and an electromagnetic force run in the same direction in the base stand allowing the housing to rotate continuously. Due to the 360 degree constant rotation of the fan, the electrical cord may be connected to the motor through two round plates insulated in the middle. Since the plates and discs need not rotate with the remainder of the unit, the electrical cord will not entangle.

Figure 7:
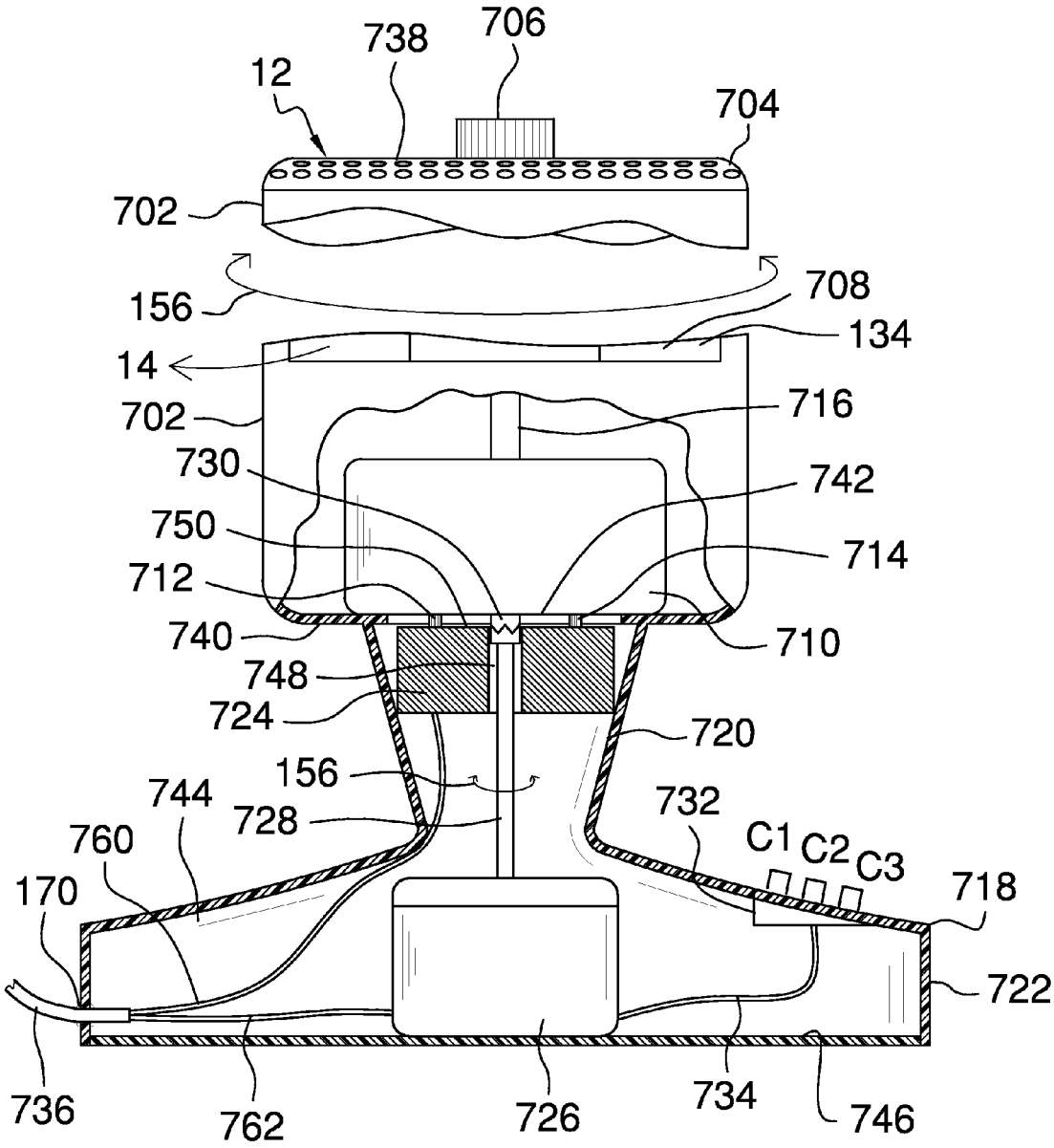
FIG. 7 is a partial section view of a fan 700 having an impeller housing 702.

FIG. 7 is a partial section view of a fan 700 having an impeller housing 702. Fan 700 may be a centrifugal fan capable of rotating impeller housing 702 continuously over 360 degrees for directional output. In addition, fan 700 may be capable of rotating impeller housing 702 both clockwise (left) and counterclockwise (right). Further, fan 700 may be capable of fixing impeller housing 702 to prevent impeller housing 702 from rotating so that fan 700 provides air output in a fixed direction.

Fan 700 may include impeller housing 702, a fan cap 704, a control knob 706, an impeller 708, an impeller motor 710 having a positive brush 712 and a negative brush 714, an impeller shaft 716, a base 718 having a trunk 720 positioned on a platform 722, a contact ring 724, a housing motor 726, a housing shaft 728, a gear system 730, a housing motor switch 732, a switch-to-housing motor wire 734, and a power cord 736. Control knob 706 may be attached to a fan cap top 738 of fan cap 704. Impeller housing 702 may be secured to fan cap 704 and impeller 708 may be positioned within impeller housing 702. Impeller motor 710 may be positioned within impeller housing 702 and impeller shaft 716 may be connected between impeller 708 and impeller motor 710 to rotate impeller 708. Impeller housing 702 may reside on trunk 720. Contact ring 724 may be positioned within trunk 720 so that positive brush 712 and negative brush 714 of impeller motor 710 may reside against contact ring 724.

Housing motor 726 may be positioned within base 718 and housing shaft 728 may be connected to housing motor 726. Gear system 730 may be connected between housing shaft 728 and impeller motor 710 to rotate both impeller motor 710 and impeller housing 702. Housing motor switch 732 may be attached to platform 722 and connected to housing motor 726 by switch-to-housing motor wire 734 to control housing motor 726. Power cord 736 may be attached to contact ring 724 and to housing motor 726.

In operation, impeller shaft 716 may be rotated by turning control knob 704 to draw room air 12 into fan 700 through fan cap top 738 and leave louvers openings 134 and louver openings 136 (not shown in FIG. 7) as conditioned air 14. Housing motor 726 may determine whether impeller housing 702 may (i) rotate continuously over 360 degree, (ii) rotate clockwise and/or counterclockwise, or (iii) remain fixed without rotating. Housing motor switch 732 may include three switches to control the 360 degree rotation, clockwise and/or counterclockwise rotation, and the stable modes of impeller housing 702. Impeller housing 702 may be moved back and forth at a constant rate between two points so that impeller housing 702 rotates at less than 360 degrees.

Impeller housing 702 may include an impeller housing bottom 740. Impeller housing bottom 740 may be a flat, disc shaped support structure at a lowest portion of impeller housing 702. Impeller housing bottom 740 may include an impeller housing bottom opening 742 in a center of impeller housing bottom 740 to permit positive brush 712, negative brush 714, and gear system 730 to pass there through.

Fan cap 704 may be a round cover positioned at an upper side of impeller housing 702. Fan cap 704 may have fan cap top 738 as an uppermost surface and include fan cap holes 132 in fan cap top 738. Fan cap holes 132 may be pattern openings through fan cap top 738 to admit room air 12 into impeller housing 702.

Control knob 706 may be a handle positioned in a center of fan cap 704 and have a round shape that may be rotated by a person's fingers. Rotating control knob 706 may operate impeller motor 710 of fan 700 such as by turning on and off impeller motor 710. Control knob 706 may be wirelessly connected to impeller motor 710. Control knob 706 may be connected to impeller motor 710 through wires passing through a hollow impeller shaft 716.

Impeller 708 may be similar to impeller 118. Impeller 708 may be a device to create a current of air (conditioned air 14) by movement of blades.

Impeller motor 710 may be a device that converts electrical power into rotary mechanical motion. Impeller motor 710 may be fixed to impeller housing bottom 740 and may rotate relative to contact ring 724 to turn impeller housing 702 in a direction of rotation arrow 156 (FIG. 7). Impeller housing 702, impeller motor 710, and housing shaft 728 may rotate in a direction of rotation arrow 156. In this example, housing motor 726 may cause rotation of both impeller motor 710 and impeller housing 702. Housing motor 726 may be operated at a different speed than impeller motor 710. Thus, louver openings 134 and louver openings 136 may be rotated at a different speed than impeller 708.

Impeller motor 710 may rotate relative to contact ring 724 and receive power from contact ring 724. To receive power from contact ring 724 and rotate relative to contact ring 724, impeller motor 710 may include positive brush 712 and negative brush 714. Positive brush 712 and negative brush 714 each may include metallic bristles that extend down from impeller motor 710 to run against contact ring 724 as impeller motor 710 rotates relative to contact ring 724. The metallic bristles may convey electricity from contact ring 724 into impeller motor 710 to power impeller motor 710. Impeller shaft 716 may be similar to impeller shaft 120.

Base 718 may be a foundation upon which impeller housing 702, impeller 708, and impeller motor 710 may be supported. Base 718 may include a base interior 744, where base interior 744 may be hollow. Platform 722 may be a raised round support having a removable flat platform bottom 746. Housing motor 726 may reside on platform bottom 746. Trunk 720 may rise up from platform 722 to meet impeller housing 702.

Contact ring 724 may be a disc structure having a contact ring hole 748. Contact ring 724 may provide electricity to impeller motor 710 through a negative voltage track and a positive voltage track separated by insulation on a contact ring upper surface 750. Trunk 720 may taper inward to provide a bottom support for contact ring 724.

Housing motor 726 may be a device that converts electrical power into rotary mechanical motion. Housing motor 726 may be fixed to platform bottom 746 and may rotate housing shaft 728. Housing shaft 728 may be a vertically orientated, round rod to transfer rotary motion from housing motor 726 to impeller motor 710. Housing shaft 728 may rotate the entire impeller motor 710 through gear system 730.

Figure 8:
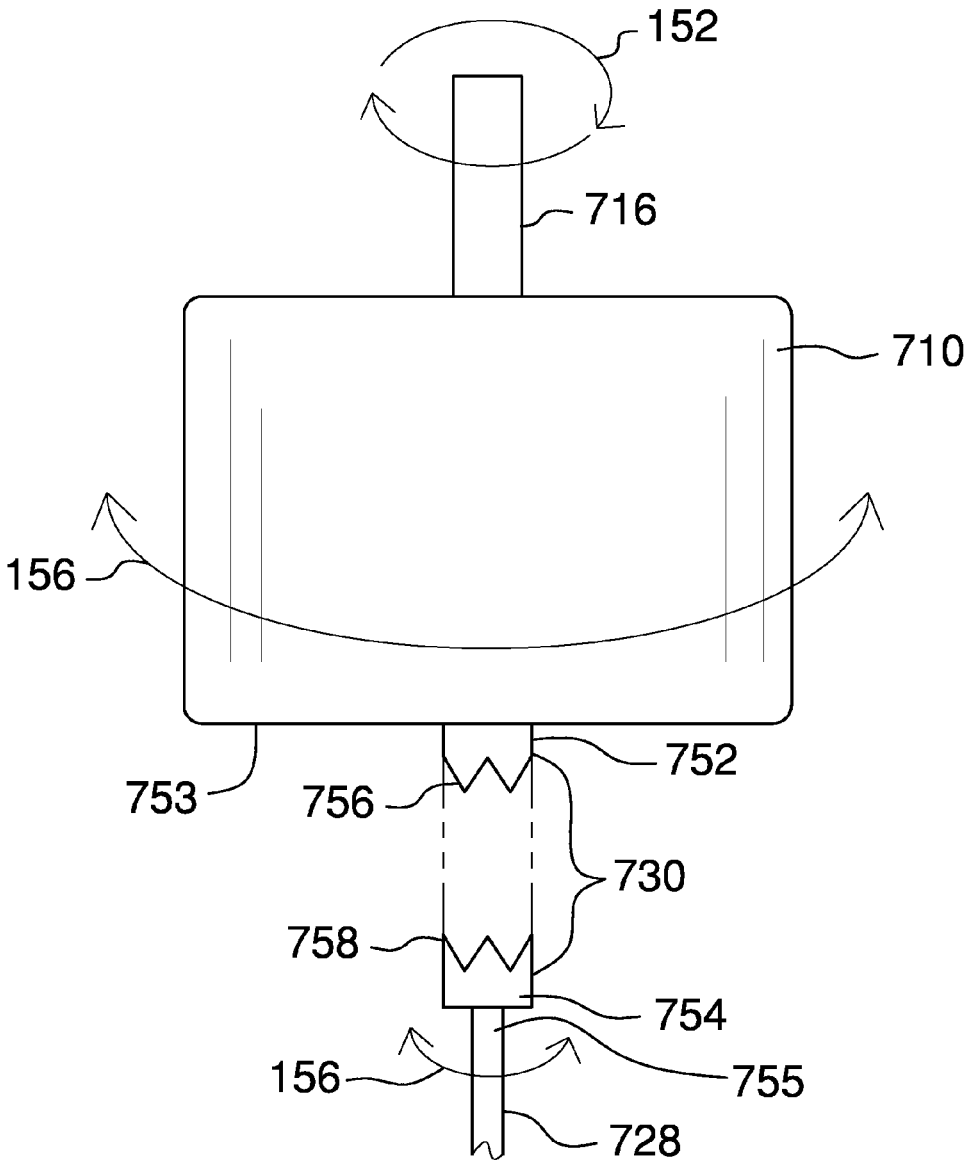
FIG. 8 is a detailed view of gear system 730.

FIG. 8 is a detailed view of gear system 730. Gear system 730 may include an impeller motor gear 752 fixed to a bottom 753 of impeller motor 710 and a housing motor gear 754 fixed to an upper end 755 of housing shaft 728. Impeller motor gear 754 may include impeller motor gear teeth 756 that project at right angles to the rotation plane of impeller motor gear 754. Housing motor gear 754 may include housing motor gear teeth 758 that project at right angles to the rotation plane of housing motor gear 754 to mesh with impeller motor gear teeth 756. Here, impeller motor gear 752 may be removeably connected to housing motor gear 754.

Housing motor switch 732 (FIG. 7) may be a control to make, break, and/or change the connections in a circuit. Housing motor switch 732 may include three switches: housing motor switch C1, housing motor switch C2, and housing motor switch C3. Housing motor switch C1 may control whether housing shaft 728 may rotate clockwise (left) and/or counterclockwise (right). Pressing C1 may cause housing motor switch C2 may control whether housing shaft 728 rotates 360 degrees. Housing motor switch C3 may control the on/off status of housing motor 726.

Pressing C1, C2, and C3 may cause impeller housing 702 to rotate clockwise continuously over 360 degrees. Pressing C2 and C3 may cause impeller housing 702 to rotate counterclockwise continuously over 360 degrees. Pressing both C3 and C1 may cause impeller housing 702 to oscillate over a less than 360 degree rotation. Depressing C3 prevents impeller housing 702 from rotating.

Power cord 736 may be a cord set or cable that may temporarily connect fan 700 to an electrical power source. Power cord 736 may include a cable having a power plug to connect to a single-phase alternating current power source at mains voltage (100 to 240 volts). Power cord 736 may pass into base interior 744 through grommet 170 and branch off to connect to contact ring 724 through an impeller motor branch 760 and to housing motor 726 through a housing motor branch 762.

The housing motor may be configured to rotate the housing shaft in both directions, that is, left and right, or turn housing shaft in one direction to provide a 360 degree rotation. The impeller housing may oscillate. The housing motor may be turned off so that the housing shaft does not rotate and the impeller housing may be in a constant position while the impeller motor may rotate the impeller.

Appealing features of the fan include the improved cooling effect it may provide. The fan may provide an evaporative cooling effect to the skin. Its continuous, 360 degree unidirectional rotation may enable the fan to provide this evaporative cooling effect throughout a room. Alternatively, the fan may rotate between two positions, such as less than 360 degrees. This fan also may endow it with a smaller footprint than conventional fans. The height of the fan may be three to four feet.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A fan capable of 360 degree continuous rotation, the fan comprising:

a fan cap having a control knob attached to a fan cap top of the fan cap;

a motor housing;

a motor positioned within the motor housing, where the motor includes a positive brush and a negative brush;

an impeller housing secured between the fan cap and the motor housing;

an impeller positioned within the impeller housing;

an impeller shaft connected between the impeller and the motor to rotate the impeller;

a base having a trunk positioned on a platform, where the motor housing resides on the trunk;

a gear system connected between the motor and the impeller housing to rotate the impeller housing in 360 degree continuous rotation;

a contact ring support attached to the base;

a contact ring attached to the impeller shaft and positioned between the motor and the contact ring support, where the positive brush and the negative brush of the motor reside against the contact ring;

the motor rotates relative to the contact ring and receives power from the contact ring via the positive and negative brushes;

a power cord attached to, the contact ring support;

the motor housing bearing plate attached to a top of the motor housing between the impeller housing and the motor and includes a motor stabilizer ring attached to the motor housing within a motor housing interior and below motor housing bearing plate.

2. The fan of claim 1, where the impeller housing includes a first louver openings positioned through impeller housing and a second louver openings positioned through the impeller housing on a side of the impeller housing that is opposite of the first louver openings.

3. The fan of claim 1, where the motor housing bearing plate includes a thrust bearing positioned on top of the motor housing bearing plate and against the impeller housing bottom.

4. The fan of claim 3, where the motor is configured to rotate, where the motor stabilizer ring includes a rolling-element bearing positioned around the motor, where the gear system includes an idler gear, a rotation gear, rotation gear fasteners, and a drive gear having a drive gear shaft, where the drive gear shaft passes through an impeller housing bottom opening and a motor housing bearing plate opening to connect the motor to the drive gear, where the idler gear connects the drive gear to the rotation gear, and where rotation gear fasteners secure the rotation gear to an impeller housing bottom.

* * * * *